US011440328B2

(12) United States Patent
Zhao et al.

(10) Patent No.: US 11,440,328 B2
(45) Date of Patent: Sep. 13, 2022

(54) INK CARTRIDGE HAVING INNER CONTAINER AND PROCESSING METHOD THEREFOR

(71) Applicant: SPEED INFOTECH (BEIHAI) COMPANY LIMITED, Beihai (CN)

(72) Inventors: Chenhai Zhao, Beihai (CN); Baohai Li, Beihai (CN)

(73) Assignee: SPEED INFOTECH (BEIHAI) COMPANY LIMITED, Beihai (CN)

( * ) Notice: Subject to any disclaimer, the term of this patent is extended or adjusted under 35 U.S.C. 154(b) by 0 days.

(21) Appl. No.: 17/310,310

(22) PCT Filed: Jan. 23, 2020

(86) PCT No.: PCT/CN2020/074035
§ 371 (c)(1),
(2) Date: Jul. 27, 2021

(87) PCT Pub. No.: WO2020/156489
PCT Pub. Date: Aug. 6, 2020

(65) Prior Publication Data

US 2022/0143983 A1 May 12, 2022

(30) Foreign Application Priority Data

Jan. 30, 2019 (CN) ..... 201910093656.5

(51) Int. Cl.
*B41J 2/175* (2006.01)

(52) U.S. Cl.
CPC ..... *B41J 2/17546* (2013.01); *B41J 2/17513* (2013.01); *B41J 2/17553* (2013.01); *B41J 2/17559* (2013.01)

(58) Field of Classification Search
CPC ..... B41J 2/17503; B41J 2/17506; B41J 2/17509; B41J 2/17513; B41J 2/17546; B41J 2/17553; B41J 2/17559
See application file for complete search history.

(56) References Cited

U.S. PATENT DOCUMENTS 6,488,369 B1 * 12/2002 Steinmetz ..... B41J 2/1752 347/50
6,634,738 B1 * 10/2003 Shinada ..... B41J 2/17513 347/86

(Continued)

FOREIGN PATENT DOCUMENTS

CN 101337464 A 1/2009
CN 201856448 U 6/2011

(Continued)

OTHER PUBLICATIONS

International Search Report (with English translation) issued in International Patent Application No. PCT/CN2020/074035, dated Apr. 28, 2020, 5 pages.

(Continued)

*Primary Examiner* — Anh T Vo
(74) *Attorney, Agent, or Firm* — MH2 Technology Law Group LLP

(57) ABSTRACT

The present application discloses an inner container type ink cartridge and a manufacturing method thereof. The manufacturing method includes the following steps: removing an upper cover of an original ink cartridge to obtain a cartridge shell; electrically connecting an external control circuit board with an original control circuit board of the original ink cartridge; arranging an internal control circuit board at a corresponding position of an inner container; and installing the inner container in the cartridge shell, so that internal contacts of the internal control circuit board of the inner container are electrically connected with the external control (Continued)

circuit board. A first chip of the external control circuit board or a second chip of the internal control circuit board is written with actual ink volume data of the inner container and an adopted program.

13 Claims, 12 Drawing Sheets

(56) References Cited

U.S. PATENT DOCUMENTS

| | | | | |
|---|---|---|---|---|
| 7,841,711 | B2 * | 11/2010 | Matsumoto | B41J 2/17543 347/86 |
| 2002/0180851 | A1 * | 12/2002 | Saruta | G06K 15/102 347/86 |
| 2007/0091131 | A1 | 4/2007 | Hatsui et al. | |
| 2015/0042457 | A1 | 2/2015 | Thacker, III et al. | |

FOREIGN PATENT DOCUMENTS

| | | | |
|---|---|---|---|
| CN | 201856451 | U | 6/2011 |
| CN | 102133818 | A | 7/2011 |
| CN | 204506141 | U | 7/2015 |
| CN | 105500930 | A | 4/2016 |
| CN | 109605941 | A | 4/2019 |
| CN | 209794884 | U | 12/2019 |
| EP | 1767365 | A1 | 3/2007 |
| EP | 3222426 | A1 | 9/2017 |
| JP | 2016221859 | A | 12/2016 |

OTHER PUBLICATIONS

Written Opinion of the International Searching Authority (with English translation), issued in International Patent Application No. PCT/CN2020/074035, dated Apr. 28, 2020, 8 pages.

First Office Action issued in Japanese Patent Application No. 2021-544447 dated Feb. 1, 2022, 4 pages.

Extended European Search Report issued in European Patent Application No. 20749514.4 dated Feb. 18, 2022, 7 pages.

* cited by examiner

INK CARTRIDGE HAVING INNER CONTAINER AND PROCESSING METHOD THEREFOR

CROSS-REFERENCE TO RELATED APPLICATIONS

This application is a national stage entry from international Application No. PCT/CN2020/074035, filed on Jan. 23, 2020, in the Receiving Office ("RO/CN") of the China National Intellectual Property Administration ("CNIPA"), and published as International Publication No, WO 2020/156489 A1 on Aug. 6, 2020; International Application No. PCT/CN2020/074035 claims priority from Chinese Patent Application No. 201910093656.5, filed on Jan. 30, 2019, in CNIPA, the entire contents of all of which are incorporated herein by reference.

TECHNICAL FIELD

The present disclosure relates to the technical field of remanufactured ink cartridges, in particular to an inner container type ink cartridge and a manufacturing method thereof.

BACKGROUND

An ink cartridge is responsible for the output function of a printer, and passively accepts instructions to work. The quality of the ink cartridge does not have any influence on a mainboard or program of the printer. However, waste ink cartridges can cause great environmental pollution, mainly in three aspects: white pollution caused by non-degradable plastic shells, water pollution caused by colored ink, and air particulate pollution caused by black and colored powder.

In view of the environmental pollution caused by waste ink cartridges, in 2008, the first local standard for renewable consumables in the country, Technical Specifications for Remanufactured Ink Cartridges for Inkjet Printers, was implemented in Shanghai, which realizes printing cost reduction, money saving and energy conservation for a user by reusing waste ink cartridges.

Since most of the waste ink cartridges are integrated ink cartridges, as soon as ink is used up, the ink cartridges are discarded while still in good condition and can be reused. Besides, even if the ink cartridges are filled repeatedly with ink, if an original control circuit board is not treated, the printer cannot obtain the actual ink volume in the ink cartridges after ink injection through the original control circuit board, which is very inconvenient for users.

CONTENT OF THE PRESENT INVENTION

The present disclosure will solve the technical problems that for an existing inner container type ink cartridge, a cartridge shell cannot be reused by replacing an inner container, and a printer cannot obtain the actual ink volume in the inner container type ink cartridge, and provides an inner container type ink cartridge and a manufacturing method thereof.

The technical solution provided by the present disclosure is as follows:

A manufacturing method of an inner container type ink cartridge includes the following steps:

S10, removing an upper cover of an original ink cartridge to obtain a cartridge shell;

S20, electrically connecting an external control circuit board with an original control circuit board of the original ink cartridge, so that contacts on the original control circuit board communicate with the external control circuit board;

S30, arranging an internal control circuit board at a corresponding position of an inner container; and S40, installing the inner container in the cartridge shell, so that internal contacts of the internal control circuit board of the inner container are electrically connected with the external control circuit board for conduction to obtain the inner container type ink cartridge;

wherein a first chip of the external control circuit board or a second chip of the internal control circuit board is written with actual ink volume data of the inner container and an adopted program.

According to the method, a waste ink cartridge in the prior art is reused as the cartridge shell, and the cartridge shell is used together with the replaceable inner container, thereby saying resources for manufacturing the cartridge shell. The internal control circuit board and the external control circuit board are respectively arranged on the inner container and the cartridge shell, and the actual ink volume data of the inner container and the adopted program are written in the first chip of the external control circuit board or the second chip of the internal control circuit board. Therefore, when the inner container type ink cartridge is placed in a printer for use, the first chip and the second chip work together, and the printer can read the actual ink volume of the inner container through the external control circuit board and the internal control circuit board, thus overcoming the problems of waste ink cartridges in the prior art that the ink volume cannot be displayed after refilling and the ink volume is hard to control in use.

Preferably, in step S20, a communication hole is formed in the cartridge shell to connect the external control circuit board to the original control circuit board of the original ink cartridge, so that the contacts on the original control circuit board communicate with some external contacts at corresponding positions of the external control circuit board in a one-to-one correspondence mode, and the remaining external contacts extend into the cartridge shell through the communication hole.

Preferably, in step S20, the external control circuit board and the internal control circuit board are connected through a conductive piece, so that two circuit connection ports of the conductive piece are respectively connected with the external contacts on the external circuit board and the internal contacts on the internal control circuit board.

Preferably, in step S20, some external contacts of the external control circuit board are connected to the original control circuit board, and the external control circuit board is bent along the cartridge shell into the shell slot, so that remaining external contacts on the external control circuit board are located in the shell slot.

Preferably, in step S10, after removing the upper cover of the original ink cartridge, a grid in an inner cavity of the original ink cartridge is milled off, a sponge is taken out, and ink in the inner cavity of the original ink cartridge is washed off.

By milling off the grid in the waste ink cartridge, the volume of the inner container which can be stored in the cartridge shell can be expanded, so as to increase the maximum ink storage capacity of the obtained inner container type ink cartridge. By washing off the ink in the original ink cartridge, ink contaminating the hand when the inner container of the inner container type ink cartridge is replaced can be avoided, so that consumer experience can be improved.

Preferably, after step S40, the method also includes step S41: cleaning the sponge taken out, and putting the sponge into the inner container.

In order to reuse the sponge in the original ink cartridge, the sponge taken out is cleaned and put into the inner container, which can save a large amount of sponges in the ink cartridge recycling process, thus saving the regeneration cost of the inner container type ink cartridge.

Preferably, in step S20, the contacts on the original control circuit board are welded with some external contacts at corresponding positions of the external control circuit board in a one-to-one correspondence mode, so as to communicate with each other.

Preferably, the internal contacts of the internal control circuit board in step S30 are arranged on an end face, away from the inner container, of the internal control circuit board.

The present disclosure also provides an inner container type ink cartridge which is manufactured by the above manufacturing method of the inner container type ink cartridge. The inner container type ink cartridge includes: a cartridge shell, the cartridge shell being provided with a shell slot, and the cartridge shell being provided with an original control circuit board; an external control circuit board, the external control circuit board being provided with a first chip, and the external control circuit board electrically communicating with the original control circuit board; and an inner container and an internal control circuit board, the internal control circuit board being installed on the inner container, the internal control circuit board being provided with a second chip, and the internal control circuit board being provided with internal contacts; wherein after the inner container is placed in the cartridge shell, the external control circuit board electrically communicates with the internal contacts, and the first chip or the second chip stores actual ink volume data of the inner container and an adopted program.

In the above structure of the inner container type ink cartridge, ink can be added by replacing the inner container, so that the whole inner container type ink cartridge does not have to be discarded after ink is used up, thus saving resources. The internal control circuit board on the inner container communicates with the external control circuit board on the cartridge shell to work together. When the inner container type ink cartridge is placed in the printer, the printer controls the ink output of the inner container through the external control circuit board and the internal control circuit board to realize the ink output function and other functions of the inner container type ink cartridge. Further, because the actual ink volume of the inner container is stored in the first chip or the second chip, the printer can read the actual ink volume of the inner container in the inner container type ink cartridge, thus overcoming the problem of waste ink cartridges in the prior art that the ink volume cannot be displayed after refilling.

Preferably, the cartridge shell is provided with a communication hole, so that external contacts, corresponding to the internal contacts, on the external control circuit board penetrate through the communication hole and extend into the shell slot, and after the inner container is placed in the shell slot, the external contacts in the shell slot communicate with the internal contacts.

The cartridge shell is provided with the communication hole, the external control circuit board is provided with a plurality of external contacts, the plurality of external contacts are divided into a first part and a second part, the external contacts of the first part communicate with contacts on the original control circuit board, the external contacts of the second part extend into the shell slat through the communication hole, and the external contacts of the first part penetrate through the external control circuit board to install the inner container in the shell slot, so that the external contacts, located in the shell slot, on the external control circuit board communicate with the internal contacts.

Preferably, the external control circuit board and the internal control circuit board are connected through a conductive piece.

When the inner container is installed in the shell slot, the external control circuit board and the internal control circuit board are connected through the conductive piece to realize the conduction between the external control circuit board and the internal control circuit board, and the conductive piece is provided with the two circuit connection ports. In this technical solution, the conductive piece can be U-shaped, and both sides of the U-shaped conductive piece are respectively located inside and outside the shell slot, so that a side, located outside the shell slot, of the U-shaped conductive piece is connected with the original control circuit board, and a side, located inside the shell slot, of the U-shaped conductive piece is connected with the internal control circuit board to realize electrical communication.

At the same time, the conductive piece can also penetrate through an outer wall of the shell slot, so that the two circuit connection ports of the conductive piece are located inside and outside the shell slot, the circuit connection port located outside the shell slot corresponds to contacts on the original control circuit board, and the circuit connection port located inside the shell slot corresponds to the internal contacts on the internal control circuit board, so that electrical communication can be achieved after connection through the conductive piece.

Preferably, two circuit connection ports are arranged on the conductive piece, and the two circuit connection ports of the conductive piece are respectively connected with the external contacts of the external control circuit board and the internal contacts of the internal control circuit board.

Preferably, an opening of the cartridge shell is provided with a connection slot, so that the external control circuit board is clamped on the connection slot, some external contacts communicate with the original control circuit board, and remaining external contacts are located in the shell slot; in this way, after the inner container is placed in the shell slot, the internal contacts communicate with the external contacts located in the shell slot.

The external control circuit board is clamped in the connection slot by forming the connection slot at the mouth of the shell slot, so that some external contacts on the external control circuit board are located outside the shell slot and in one-to-one correspondence to the original control circuit board, and the external contacts in the shell slot are in one-to-one correspondence to the internal contacts, so that the internal contacts at an installation port of the inner container can communicate with the external contacts in the shell slot.

Preferably, some external contacts on the external control circuit board are connected with the contacts on the original control circuit board, the external control circuit board is bent into the shell slot along the mouth of the shell slot, and the remaining external contacts are located in the shell slot, so that when the inner container is installed in the shell slot, the external contacts in the shell slot communicate with the internal contacts.

The external control circuit board is designed as a bendable circuit board, some external contacts on the external control circuit board are connected with the original control circuit board, the external control circuit board is bent at the mouth of the shell slot and extends into the shell slot, and the remaining external contacts in the shell slot correspond to the internal contacts in position, so that the external contacts in the shell slot can communicate with the internal contacts after the inner container is installed.

Compared with the prior art, the inner container type ink cartridge and the manufacturing method thereof provided by the present disclosure have the following advantages:

According to the present disclosure, the waste ink cartridge is recycled to make the cartridge shell, the inner container for storing ink is installed in the cartridge shell, and the printing and ink output function of the inner container type ink cartridge is realized through the matching of the external control circuit board and the internal control circuit board. Because the actual ink volume data of the inner container and the adopted program are written in the first chip of the external control circuit board or the second chip of the internal control circuit board, the printer can read the actual ink volume in the inner container in real time when printing with the inner container type ink cartridge.

BRIEF DESCRIPTION OF THE DRAWINGS

The preferred embodiments will be explained below in a clear and understandable way with the accompanying drawings, and the above-mentioned characteristics, technical features, advantages and implementation methods of an inner container type ink cartridge and a manufacturing method thereof will be further explained.

Figure 1:
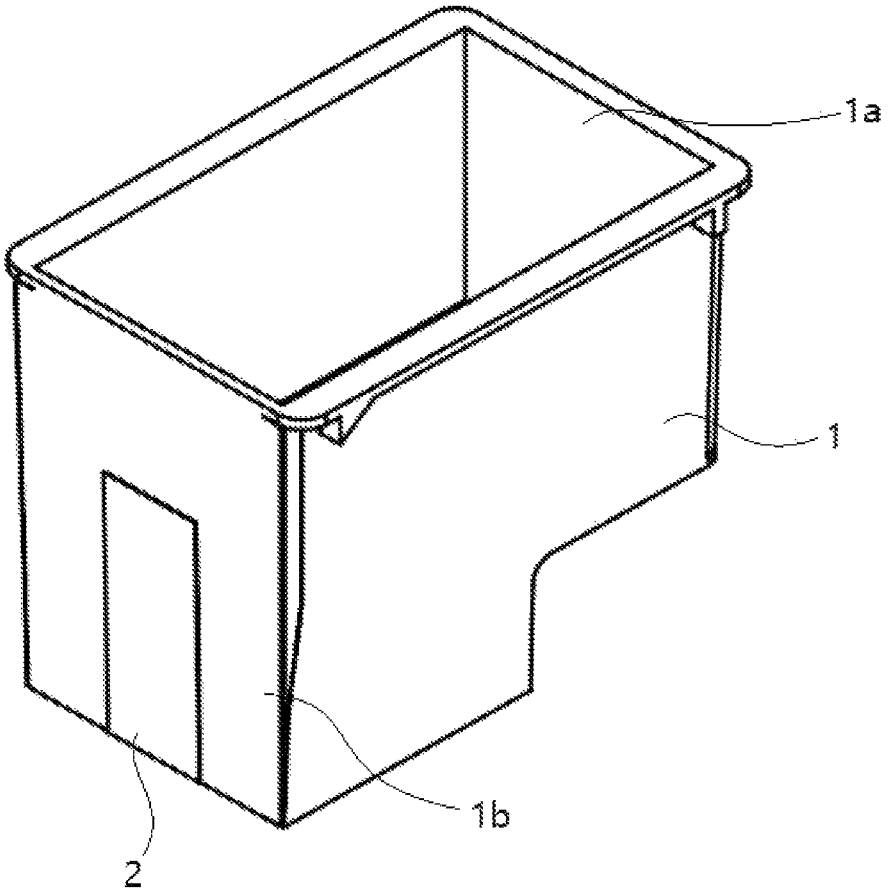
FIG. 1 is a perspective view of a cartridge shell.

Reference numerals: 1—cartridge shell, 1*a*—shell slot, 1*b*—front face of cartridge shell, 1*c*—communication hole, 2—original control circuit board, 3—external control circuit board, 3*a*—external contact, 4—inner container, 4*a*—front face of inner container, 5—internal control circuit board, 5*a*—internal contact, 6—face cover, and 7—conductive piece.

DETAILED DESCRIPTION OF THE PREFERRED EMBODIMENT

In order to explain the embodiments of the present disclosure or the technical solution in the prior art more clearly, the specific embodiments of the present disclosure will be explained with reference to the drawings. Obviously, the drawings in the following description are only some embodiments of the present disclosure. For those of ordinary skill in the art, other drawings and other embodiments can be obtained according to these drawings without creative labor.

For the sake of conciseness, only the parts related to the present disclosure are schematically shown in each drawing, and they do not represent the actual structure of the product. In addition, in order to make the drawings simple and easy to understand, in some figures, only one of the components with the same structure or function is shown schematically, or only one of them is marked. Herein, "one" means not only "only one" but also "more than one".

Figure 2:
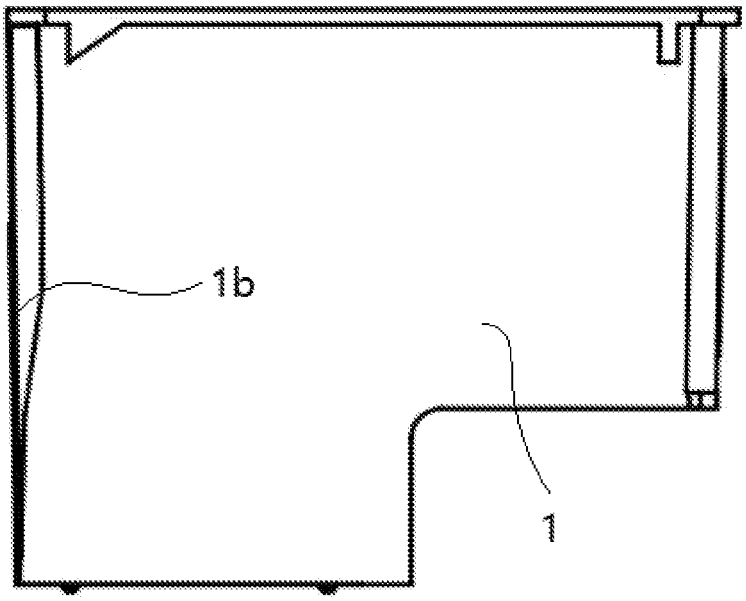
FIG. 2 is a side view of FIG. 1.
Figure 3:
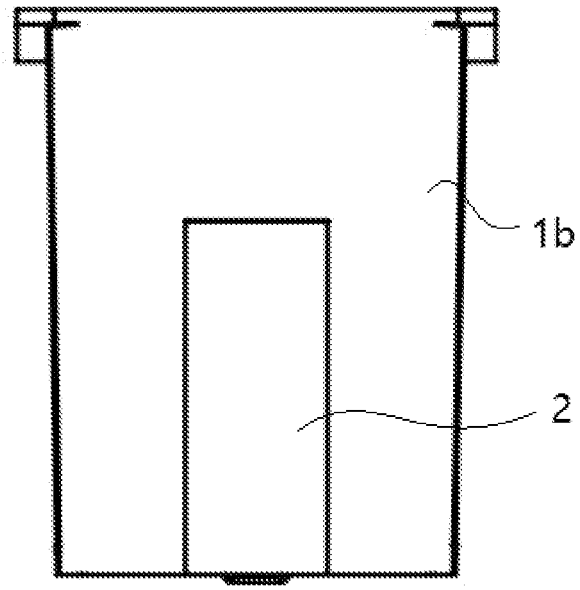
FIG. 3 is a front view of FIG. 1.

According to an embodiment provided by the present disclosure, as shown in FIGS. 1-17, Embodiment 1 is a specific embodiment of a manufacturing method of an inner container type ink cartridge, which is used for processing a waste ink cartridge (i.e., an original ink cartridge) in the prior art to obtain an inner container type ink cartridge, and includes the following steps:

as shown in FIGS. 1-3, S10, removing an upper cover of the original ink cartridge to obtain a cartridge shell 1;

S20, electrically connecting an external control circuit board 3 with an original control circuit board 2 of the original ink cartridge, so that contacts on the original control circuit board 2 communicate with the external control circuit board 3;

wherein in step S20, as shown in FIGS. 4-7, a communication hole 1*c* is formed in a front face 1*b* of the cartridge shell 1, the external control circuit board 3 is connected to the original control circuit board 2 of the original ink cartridge, and the external control circuit board 3 is provided with a first chip; in specific implementation, a part, used for being connected to an internal control circuit board 5, of the external control circuit board 3 can be extended into the cartridge shell 1, and contacts on the original control circuit board 2 communicate with some external contacts at corresponding positions of the external control circuit board 3 in a one-to-one correspondence mode; in actual operation, the contacts on the original control circuit board 2 are welded with some external contacts 3*a* at corresponding positions of the external control circuit board 3 in a one-to-one correspondence mode, so that the contacts on the original control circuit board 2 communicate with the external contacts 3*a* on the external control circuit board 3, and remaining external contacts 3*a* extend into the cartridge shell 1 through the communication hole 1*c;*

Figure 8:
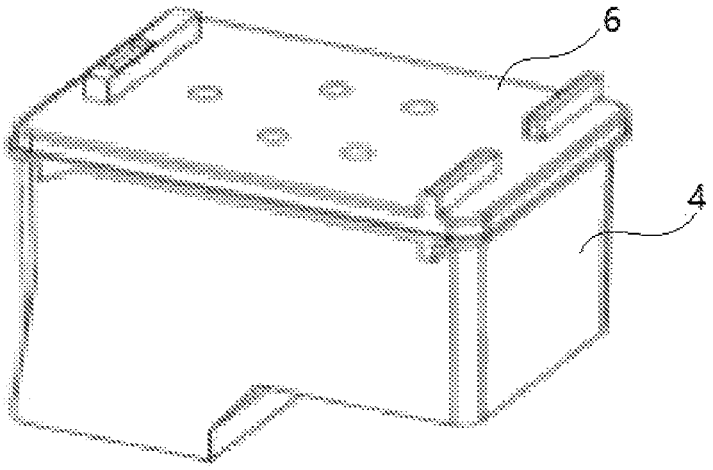
FIG. 8 is a perspective view of an inner container.
Figure 9:
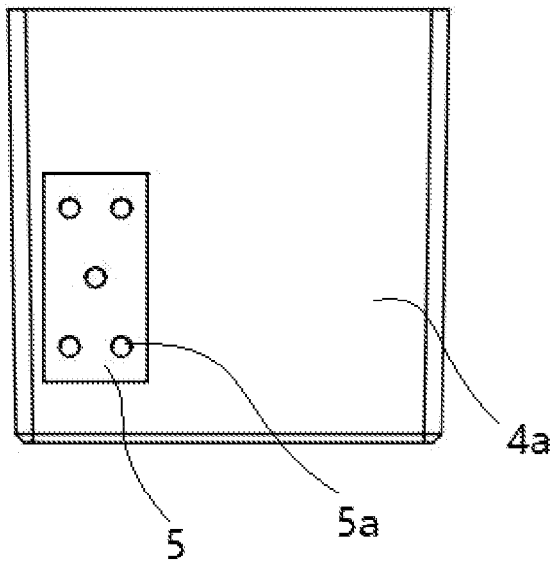
FIG. 9 is a front view of FIG. 8.
Figure 10:
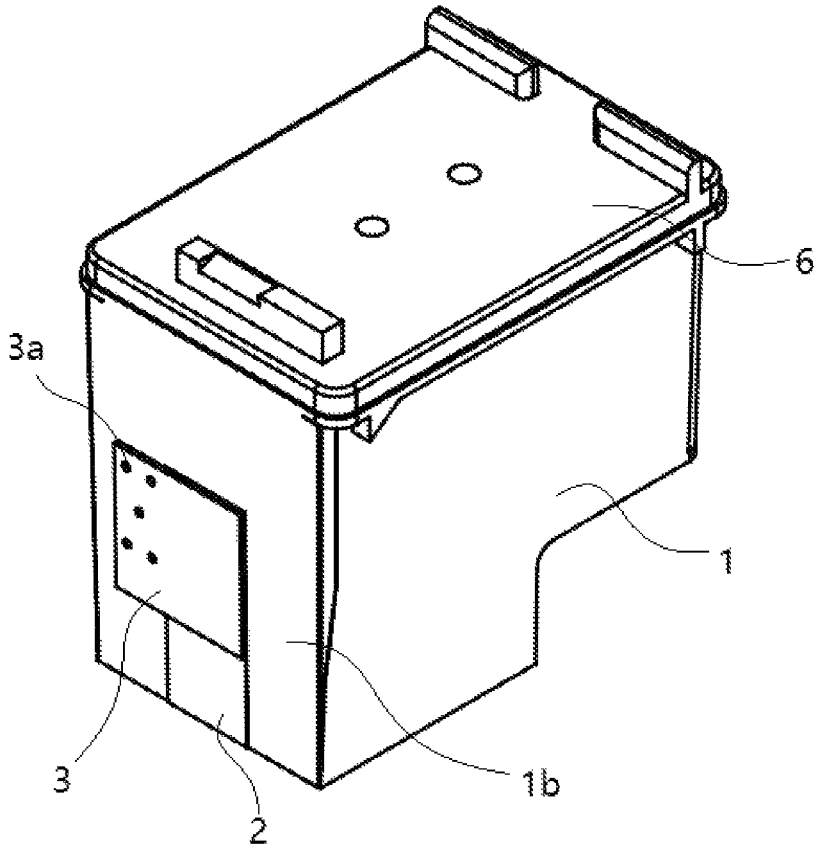
FIG. 10 is a perspective view of an inner container type ink cartridge.
Figure 11:
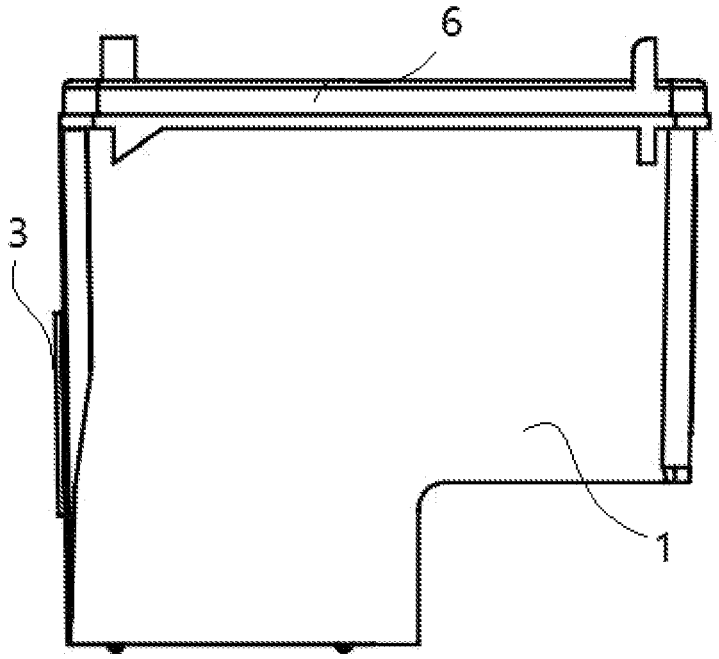
FIG. 11 is a side view of FIG. 10.
Figure 12:
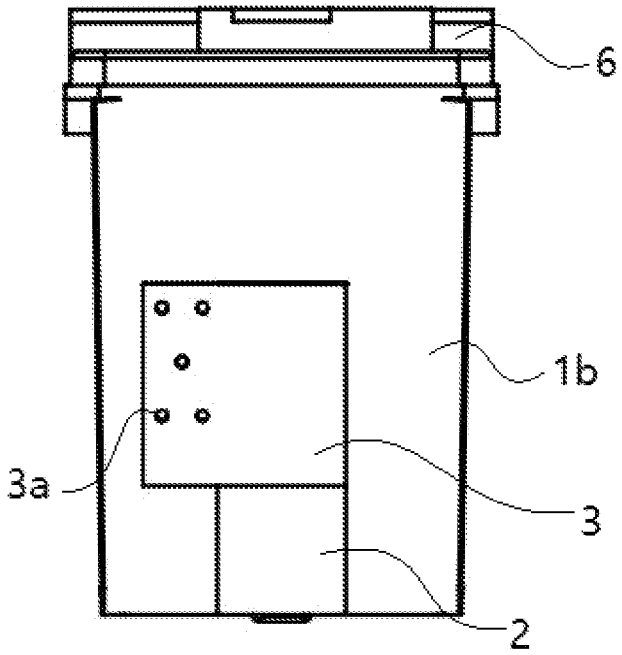
FIG. 12 is a front view of FIG. 10.

S30, arranging the internal control circuit board 5 at a corresponding position of an inner container 4; wherein as shown in FIGS. 8-9, the internal control circuit board 5 is arranged at a position, corresponding to the communication hole 1*c*, of the inner container 4, that is, a front face 4*a* of the inner container, and internal contacts 5*a* and a second chip are arranged on the internal control circuit board 5; specifically, the internal contacts 5*a* of the internal control circuit board 5 are arranged on an end face, away from the inner container 4, of the internal control circuit board 5, which facilitates the communication between the internal contacts 5*a* on the internal control circuit board 5 and the external contacts 3*a* extending into the cartridge shell 1; it should be noted that the inner container 4 can also be called an inner container ink bag; and S40, installing the inner container 4 in the cartridge shell 1, so that the internal contacts of the internal control circuit board 5 of the inner container 4 are electrically connected with the external control circuit board 3 for conduction; wherein in specific implementation, the contacts on the internal control circuit board 5 are brought into contact with a contact part, extending into the cartridge shell 1, of the external control circuit board 3 for conduction; in actual operation, the internal contacts 5*a* of the internal control circuit board 5 of the inner container 4 are electrically connected with the remaining external contacts 3*a* of the external control circuit board 3 to obtain the inner container type ink cartridge; as shown in FIGS. 10-12, the inner container 4 is installed in the cartridge shell 1, and a face cover 6 of the inner container 4 engages with an opening of the cartridge shell 1, so that the internal contacts 5*a* of the internal control circuit board 5 communicate with the external contacts 3*a* extending into the cartridge shell 1 in a one-to-one correspondence mode, and then the inner container type ink cartridge is obtained, that is, the internal contacts 5*a* and the external contacts 3*a* make contact, thereby realizing conduction and connecting circuits in the internal control circuit board 5 with circuits in the external control circuit board 3;

actual ink volume data of the inner container 4 and an adopted program are written into the first chip of the external control circuit board 3 or the second chip of the internal control circuit board 5, so that when the inner container type ink cartridge is placed in a printer, contacts of the printer communicate with the external control circuit board 3, and then the printer is connected to the internal control circuit board 5 through the external control circuit board 3, thus realizing the printing and ink output function of the inner container type ink cartridge; and the printer can obtain the current ink volume in the inner container 4 by reading the stored actual ink volume data, the first chip and the second chip can be each written with part of the data, so that the first chip and the second chip can work cooperatively when they communicate with each other.

Figure 13:
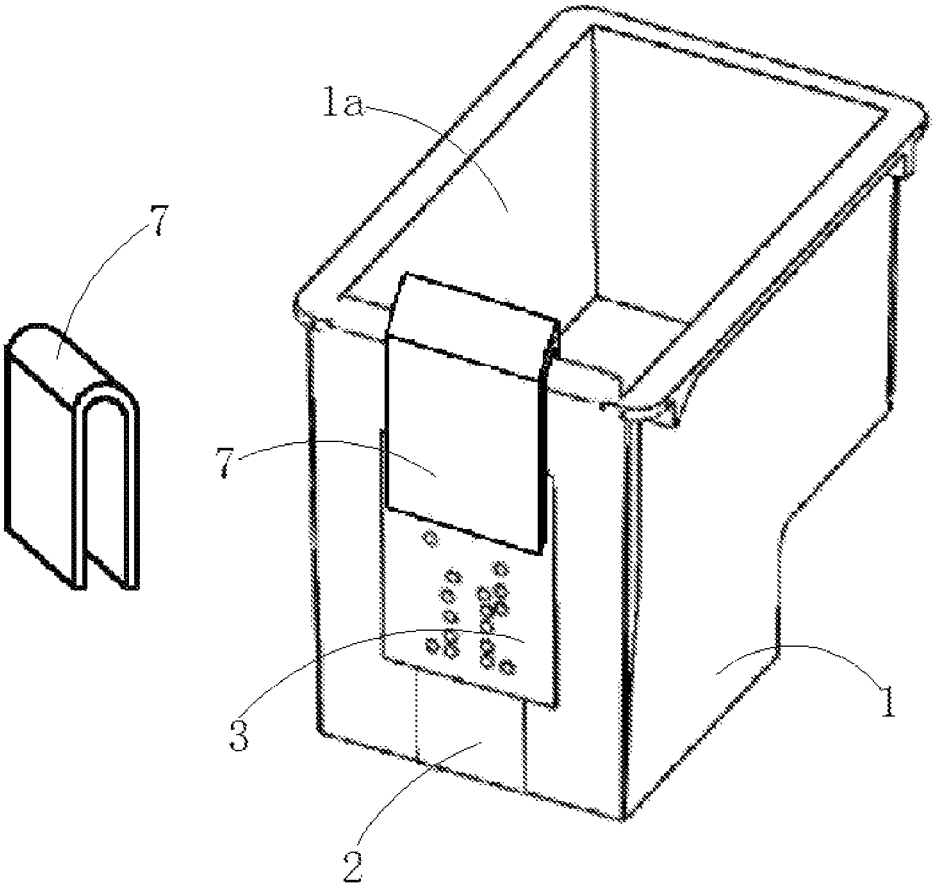
FIG. 13 is a structural diagram of another embodiment of the present disclosure.
Figure 14:
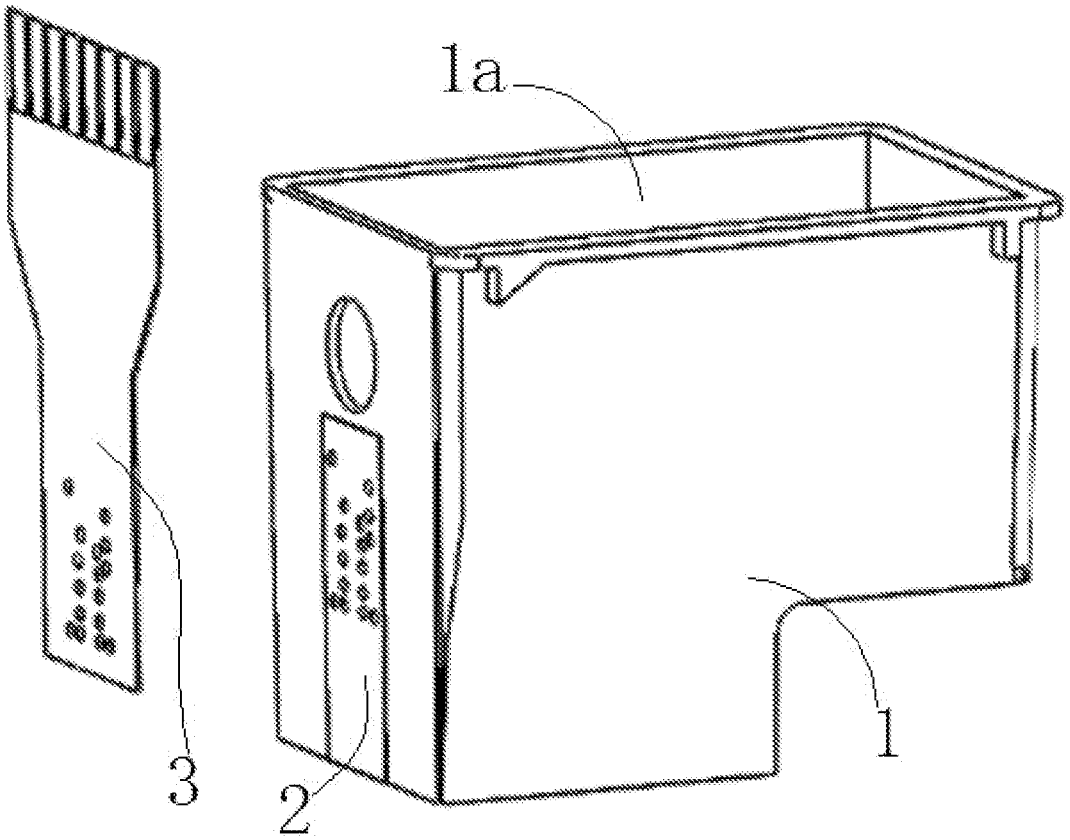
FIG. 14 is a structural diagram of yet another embodiment of the present disclosure.
Figure 15:
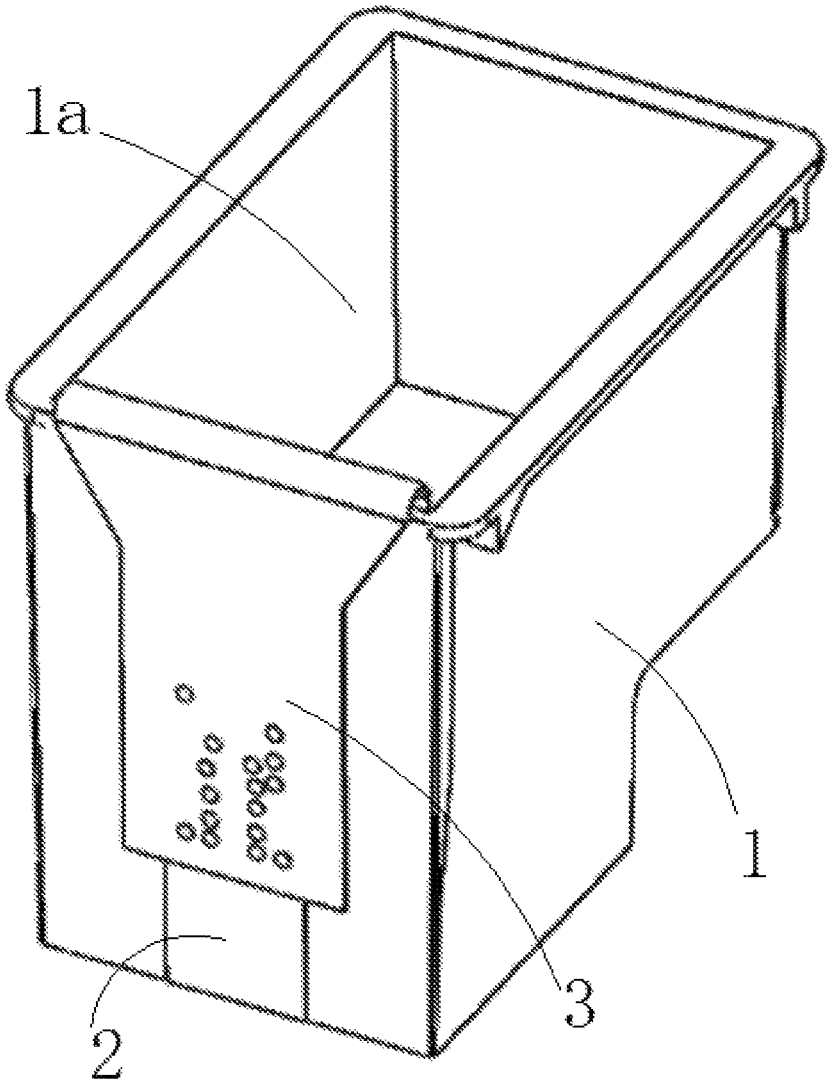
FIG. 15 is a diagram of a structure obtained after the two parts in FIG. 14 are assembled together.
Figure 16:
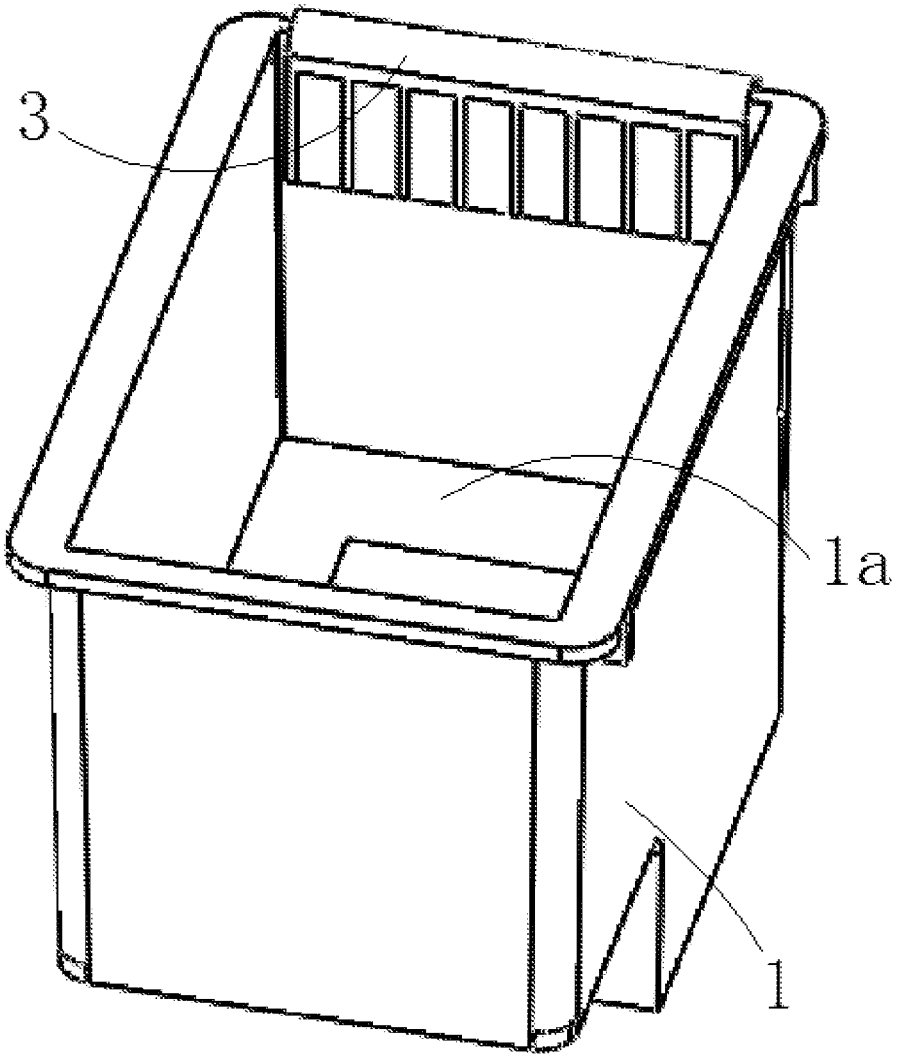
FIG. 16 is a structural diagram of FIG. 15 from another perspective.
Figure 17:
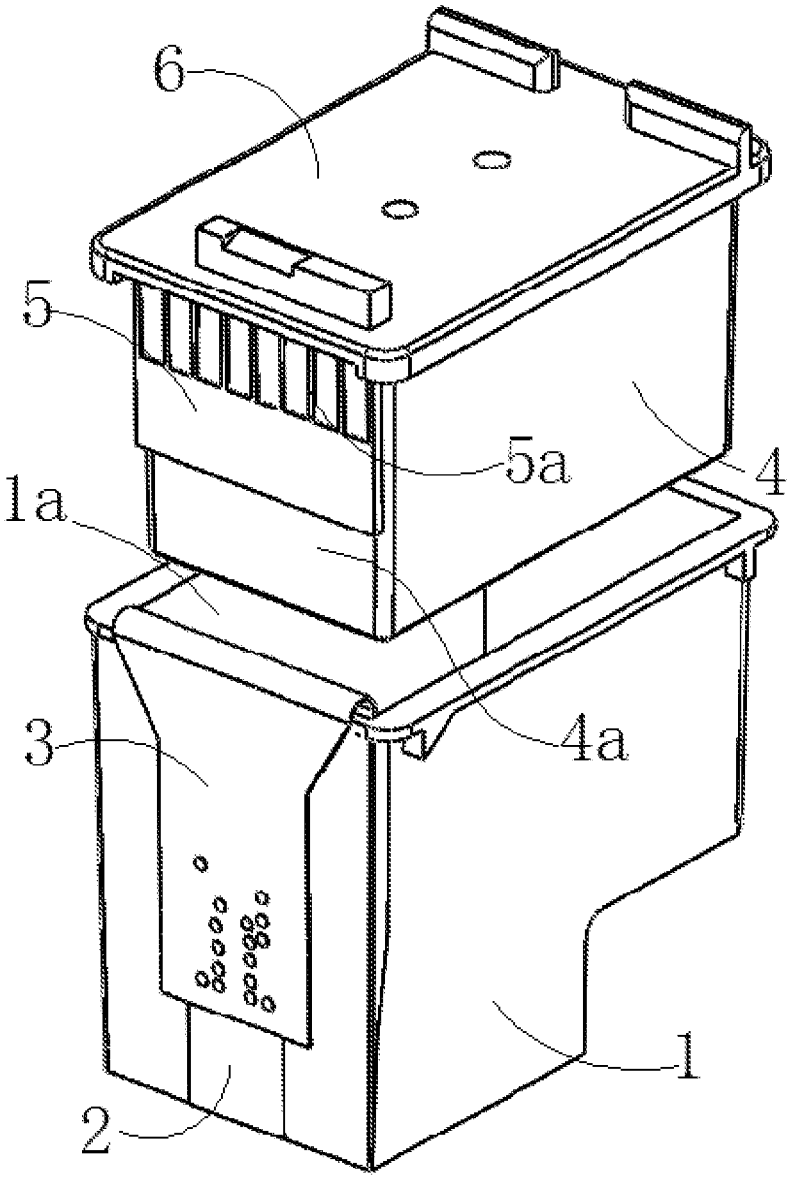
FIG. 17 is a structural diagram showing the installation of an inner container in FIG. 14.

As shown in FIG. 13, in another embodiment of the present disclosure, in step S20, the external control circuit board 3 and the internal control circuit board 5 may also be connected through a conductive piece 7, so that two circuit connection ports of the conductive piece 7 are connected with the external contact 3*a* on the external circuit board and the internal contact 5*a* on the internal control circuit board 5, respectively. In specific implementation, the two circuit connection ports of the conductive piece 7 are connected with the external contacts on the external control circuit board 3, and the other section is extended into the ink cartridge. When the inner container 4 is installed in the shell slot 1*a*, the contacts on the internal control circuit board 5 are connected with some contacts, extending into the ink cartridge, of the conductive piece 7. The conductive piece 7 can be U-shaped, and both sides of the U-shaped conductive piece 7 are respectively provided with the circuit connection ports, the two circuit connection ports respectively correspond to the original control circuit board 2 and the internal control circuit board 5, the circuit connection port located outside the shell slot 1*a* is electrically connected with the external control circuit board 3, the circuit connection port located inside the shell slot 1*a* is electrically connected with the internal contact 5*a* on the internal control circuit board 5, and a U-shaped bottom end of the U-shaped conductive piece 7 is clamped on a mouth of the shell slot 1*a*.

In specific implementation, the conductive piece 7 can also penetrate through the cartridge shell 1, so that the two circuit connection ports of the conductive piece 7 are located outside and inside the shell slot 1*a* respectively, the circuit connection port located outside the shell slot 1*a* is electrically connected with the external control circuit board 3, and the circuit connection port located inside the shell slot 1*a* communicates with the internal contacts 5*a* when the inner container 4 is installed in the shell slot 1*a* (not shown). In this embodiment, it is worth noting that, there is no requirement on the shape and placement position of the conductive piece 7. In this embodiment, it is only required that the conductive piece 7 can electrically connect the external control circuit board 3 with the internal control circuit board 5 to realize communication of the two.

As shown in FIGS. 14-17, in another embodiment of the present disclosure, in step S20, some external contacts 3*a* of the external control circuit board 3 may be connected to the original control circuit board 2, and the external control circuit board 3 is bent along the cartridge shell 1 into the shell slot 1*a*, so that remaining external contacts 3*a* on the external control circuit board 3 are located in the shell slot 1*a*.

In specific implementation, the external contacts 3*a* on the external control circuit board 3 are connected with connecting contacts of the original control circuit board 2, and then the external control circuit board 3 is folded at the mouth of the shell slot 1*a*, so that another part of the external contacts 3*a* of the external control circuit board 3 are located in the shell slot 1*a* and in one-to-one correspondence to the internal contacts 5*a*, and the internal contacts 5*a* can communicate with the external contacts 3*a*, located in the shell slot 1*a*, on the external control circuit board 3 after the inner container 4 is installed. In this embodiment, how the external control circuit board 3 is bent is also not limited. In this embodiment, the external control circuit board 3 is a flexible circuit board and is provided with the first chip. In this embodiment, the specific placement and bending shape of the external control circuit board are not specifically limited, as long as the bent external control circuit board 3 can enable the external contacts 3*a* in the shell slot 1*a* to communicate with the internal contacts 5*a* after the inner container 4 is installed.

More preferably, in step S10, after removing the upper cover of the original ink cartridge, a grid in an inner cavity of the original ink cartridge is milled off, a sponge is taken out, and ink in the inner cavity of the original ink cartridge is washed off, so as to obtain the shell slot 1*a* with a smooth inner wall, thereby expanding the volume of the inner container 4 which can be stored in the cartridge shell 1 so as to increase the maximum ink storage capacity of the obtained inner container type ink cartridge. At the same time, in order to avoid ink contaminating the hand when the inner container 4 of the inner container type ink cartridge is replaced, the ink in the original ink cartridge is washed off.

In order to reuse the sponge in the original ink cartridge, after step S40, the method also includes step S41: cleaning the sponge taken out, and putting the sponge into the inner container 4 to be reused, which saves sponges in the ink cartridge recycling process, thus saving the regeneration cost of the inner container type ink cartridge.

As shown in FIGS. 1-17, Embodiment 2 is a specific embodiment of an inner container type ink cartridge, which is manufactured by the above-mentioned manufacturing method of the inner container type ink cartridge, and specifically includes a cartridge shell 1, an external control circuit board 3, an internal control circuit board 5 and an inner container 4 for storing ink.

The cartridge shell 1 is provided with a shell slot 1*a* and an original control circuit board 2. The external control circuit board 3 is provided with a first chip, and the external control circuit board 3 electrically communicates with the original control circuit board 2. The internal control circuit board 5 is installed on the inner container 4, and the internal control circuit board 5 is provided with a second chip and internal contacts. After the inner container 4 is placed in the cartridge shell 1, the external control circuit board 3 electrically communicates with the internal contacts. The first chip or the second chip stores actual ink volume data of the inner container 4 and an adopted program.

Figure 4:
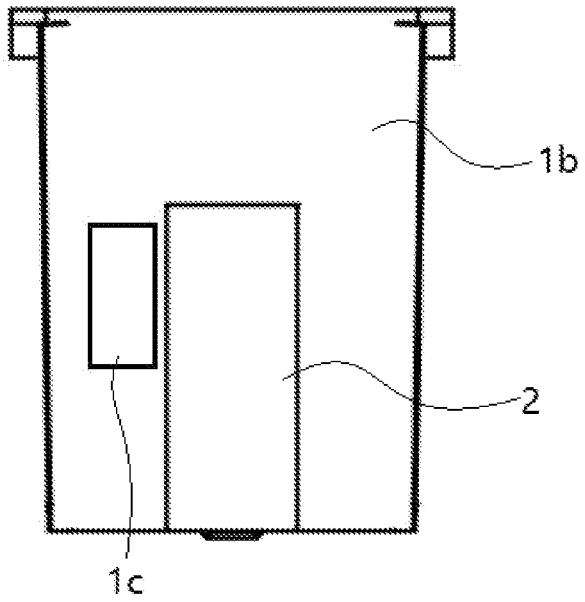
FIG. 4 is a front view of the cartridge shell after a hole is formed.
Figure 5:
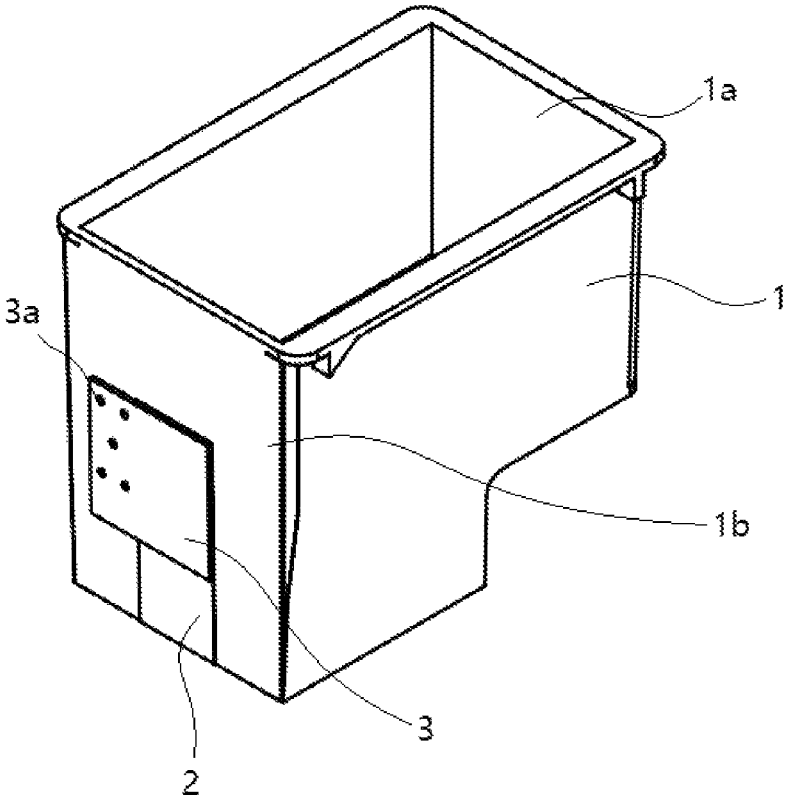
FIG. 5 is a perspective view of the cartridge shell after being attached to a first circuit board.
Figure 6:
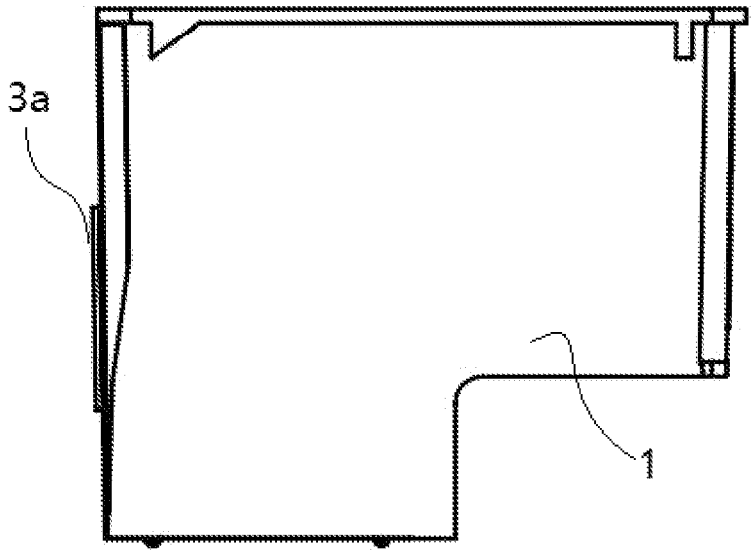
FIG. 6 is a side view of FIG. 5.
Figure 7:
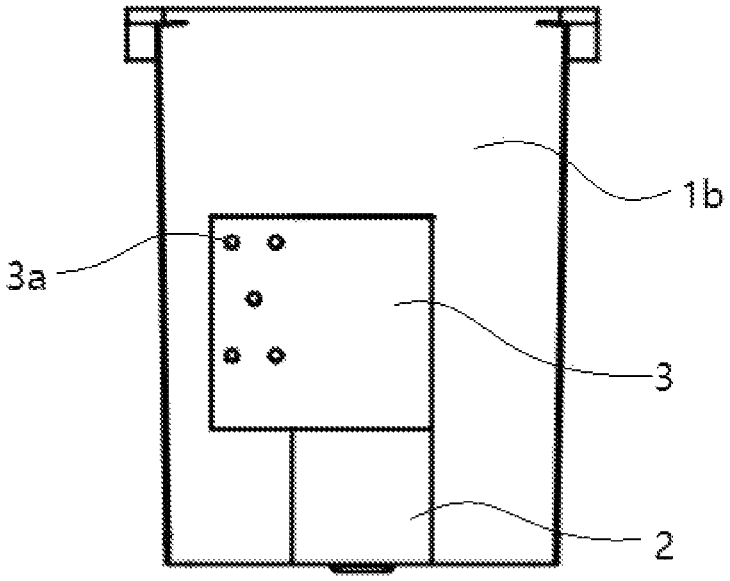
FIG. 7 is a front view of FIG. 5.

In specific implementation, as shown in FIGS. 1-4, the cartridge shell 1 is provided with a shell slot 1*a*, a front face 1*b* of the cartridge shell is provided with the original control circuit board 2, and the front face 1*b* of the cartridge shell is also provided with a communication hole 1*c*. In this embodiment, as shown in FIG. 4, the communication hole 1*c* is a quadrangular hole and is arranged on the left side of the original control circuit board 2.

As shown in FIGS. 4-7, the external control circuit board 3 is provided with the first chip for processing and storing data, and the external control circuit board 3 electrically communicates with the original control circuit board 2. In specific implementation, the external control circuit board 3 is also provided with a plurality of external contacts 3*a*, the plurality of external contacts 3*a* are divided into a first part and a second part, and the external contacts 3*a* of the first part communicate with contacts on the original control circuit board 2 by welding in a one-to-one correspondence mode, so as to realize the conduction of the external control circuit board 3 and the original control circuit board 2. The external contacts 3*a* of the second part extend into the shell slot 1*a* through the communication hole 1*c*, and the external contacts 3*a* of the first part penetrate through the external control circuit board 3 to make contact with contacts of a printer, so that the printer can smoothly communicate with the external control circuit board 3.

Of course, the communication hole 1*c* can also be round, square, triangular, etc., as long as the external contacts 3*a* of the second part can extend into the shell slot 1*a* through the communication hole 1*c*. The communication hole 1*c* may also be arranged on the right side, the upper side, etc. of the original control circuit board 2, which will not be described in detail here.

The inner container 4 is arranged in the shell slot 1*a*. As shown in FIGS. 8-9, a front face 4*a* of the inner container is provided with the internal control circuit board 5, and the internal control circuit board 5 is provided with the second chip for processing and storing data. An end face, away from the inner container 4, of the internal control circuit board 5 is also provided with a plurality of internal contacts 5*a*, the internal contacts 5*a* communicate with the external contacts 3*a* of the second part in a one-to-one correspondence mode, so as to realize the conduction between the external control circuit board 3 and the internal control circuit board 5. Only when the conduction between the external control circuit board 3 and the internal control circuit board 5 is realized, can the printer control the inner container type ink cartridge to output ink and read the actual ink volume data in the inner container 4.

The first chip is pre-written with the actual ink volume data of the inner container 4 and the adopted program, so that when the inner container type ink cartridge is installed in the printer, the printer can obtain the actual ink volume data of the inner container 4 through the first chip, thus overcoming the problem that the ink volume cannot be displayed after refilling a waste ink cartridge in the prior art.

As shown in FIGS. 10-12, a face cover 6 of the inner container 4 is clamped on a mouth of the shell slot 1*a* to isolate the shell slot 1*a* from the outside.

Referring again to FIG. 13, in another embodiment of the present disclosure, the external control circuit board 3 and the internal control circuit board 5 are connected through a conductive piece 7. In specific implementation, two circuit connection ports are arranged on the conductive piece 7, and the two circuit connection ports of the conductive piece 7 are respectively connected with the external contacts 3*a* of the external control circuit board 3 and the internal contacts 5*a* of the internal control circuit board 5. When the inner container 4 is installed in the shell slot 1*a*, the external control circuit board 3 and the internal control circuit board 5 are connected through the conductive piece 7 to realize the conduction between the external control circuit board 3 and the internal control circuit board 5, and the conductive piece 7 is provided with the two circuit connection ports. In this technical solution, the conductive piece 7 can be U-shaped, and both sides of the U-shaped conductive piece 7 are respectively located inside and outside the shell slot 1*a*, so that a side, located outside the shell slot 1*a*, of the U-shaped conductive piece 7 is connected with the original control circuit board 2, and a side, located inside the shell slot 1*a*, of the U-shaped conductive piece 7 is connected with the internal control circuit board 5 to realize electrical communication.

At the same time, the conductive piece 7 can also penetrate through an outer wall of the shell slot 1*a*, so that the two circuit connection ports of the conductive piece 7 are located inside and outside the shell slot 1*a*, the circuit connection port located outside the shell slot 1*a* corresponds to contacts on the original control circuit board 2, and the circuit connection port located inside the shell slot 1*a* corresponds to the internal contacts 5*a* on the internal control circuit board 5, so that electrical communication can be achieved after connection through the conductive piece 7. It is worth noting that in this embodiment, the conductive piece 7 is not limited to a specific shape or a specific placement position, as long as the internal contacts 5*a* can communicate with the external contacts 3*a*, located in the shell slot 1*a*, on the external control circuit board 3 after the conductive piece 7 is placed in position and the inner container 4 is arranged (not shown).

In another embodiment of the present disclosure, an opening of the cartridge shell 1 is provided with a connection slot, so that the external control circuit board 3 is clamped on the connection slot, some external contacts 3*a* communicate with the original control circuit board 2, and remaining external contacts 3*a* are located in the shell slot 1*a*; in this way, after the inner container 4 is placed in the shell slot 1*a*, the internal contacts 5*a* communicate with the external contacts 3*a* located in the shell slot 1*a*. In specific implementation, the external control circuit board 3 is clamped in the connection slot by forming the connection slot at the mouth of the shell slot 1*a*, so that some external contacts 3*a* on the external control circuit board 3 are located outside the shell slot 1*a* and in one-to-one correspondence to the original control circuit board 2, and the external contacts 3*a* in the shell slot 1*a* are in one-to-one correspondence to the internal contacts 5*a*, so that the internal contacts 5*a* at an installation port of the inner container 4 can communicate with the external contacts 3*a* in the shell slot 1*a* (not shown).

Referring to FIGS. 14-17 again, in another embodiment of the present disclosure, some external contacts 3*a* on the external control circuit board 3 are connected with the contacts on the original control circuit board 2, the external control circuit board 3 is bent into the shell slot 1*a* along the mouth of the shell slot 1*a*, and remaining external contacts 3*a* are located in the shell slot 1*a*, so that when the inner container 4 is installed in the shell slot 1*a*, the external contacts 3*a* in the shell slot 1*a* communicate with the internal contacts 5*a*. In specific implementation, the external control circuit board 3 is designed as a bendable circuit board, some external contacts 3*a* on the external control circuit board 3 are connected with the original control circuit board 2, the external control circuit board 3 is bent at the mouth of the shell slot 1*a* and extends into the shell slot 1*a*, and the remaining external contacts 3*a* in the shell slot 1*a* correspond to the internal contacts 5*a* in position, so that the external contacts 3*a* in the shell slot 1*a* can communicate with the internal contacts 5*a* after the inner container 4 is installed.

More preferably, the actual ink volume data of the inner container is stored in the second chip, so after the ink in the inner container 4 of the inner container type ink cartridge is used up, the inner container 4 can be replaced instead of the ink filling operation. Since the actual ink volume data of the inner container 4 is directly stored in the second chip, the ink volume of the new inner container 4 can be written in the second chip. When the inner container 4 is installed in the cartridge shell 1, the printer can read the actual ink volume in the inner container 4 without any other operations.

Of course, other data or programs can also be written into the first chip and the second chip, such as the color of ink, and the color of corresponding ink contained in each chamber in the inner container 4. The first chip and the second chip can be integrated to be used as one chip, which can be set according to the actual situation.

This application document is not limited to the above-mentioned embodiments, as long as the external control circuit board 3 can communicate with the internal control circuit board 5, and the communication mode will not be described in detail herein.

It should be noted that the above embodiments can be freely combined as required. The above are only preferred embodiments of the present disclosure, and it should be pointed out that for those of ordinary skill in the art, without departing from the principle of the present disclosure, several improvements and embellishments can be made, and these improvements and embellishments should also be considered within the scope of protection of the present disclosure.

What is claimed is:

1. A manufacturing method of an inner container type ink cartridge, comprising the following steps:

S10, removing an upper cover of an original ink cartridge to obtain a cartridge shell;

S20, electrically connecting an external control circuit board with an original control circuit board of the original ink cartridge, so that contacts on the original control circuit board communicate with the external control circuit board;

S30, arranging an internal control circuit board at a corresponding position of an inner container; and S40, installing the inner container in the cartridge shell, so that internal contacts of the internal control circuit board of the inner container are electrically connected with the external control circuit board to obtain the inner container type ink cartridge;

wherein a first chip of the external control circuit board or a second chip of the internal control circuit board is written with actual ink volume data of the inner container and an adopted program; and wherein the external control circuit board and the internal control circuit board are connected through a conductive piece.

2. The manufacturing method of the inner container type ink cartridge according to claim 1, wherein in step S20, a communication hole is formed in the cartridge shell to connect the external control circuit board to the original control circuit board of the original ink cartridge, so that the contacts on the original control circuit board communicate with some external contacts at corresponding positions of the external control circuit board in a one-to-one correspondence mode, and remaining external contacts extend into the cartridge shell through the communication hole.

3. The manufacturing method of the inner container type ink cartridge according to claim 1, wherein two circuit connection ports of the conductive piece are respectively connected with the external contacts on the external circuit board and the internal contacts on the internal control circuit board.

4. The manufacturing method of the inner container type ink cartridge according to claim 1, wherein in step S20, some external contacts of the external control circuit board are connected to the original control circuit board, and the external control circuit board is bent along the cartridge shell into the shell slot, so that remaining external contacts on the external control circuit board are located in the shell slot.

5. The manufacturing method of the inner container type ink cartridge according to claim 1, wherein in step S10, after removing the upper cover of the original ink cartridge, a grid in an inner cavity of the original ink cartridge is milled off, a sponge is taken out, and ink in the inner cavity of the original ink cartridge is washed off.

6. The manufacturing method of the inner container type ink cartridge according to claim 5, wherein after step S40, the method also comprises step S41: cleaning the sponge taken out, and putting the sponge into the inner container.

7. The manufacturing method of the inner container type ink cartridge according to claim 1, wherein in step S20, the contacts on the original control circuit board are welded with some external contacts at corresponding positions of the external control circuit board in a one-to-one correspondence mode, so as to communicate with each other.

8. The manufacturing method of the inner container type ink cartridge according to claim 1, wherein the internal contacts of the internal control circuit board in step S30 are arranged on an end face, away from the inner container, of the internal control circuit board.

9. An inner container type ink cartridge, comprising:

a cartridge shell, the cartridge shell being provided with a shell slot, and the cartridge shell being provided with an original control circuit board;

an external control circuit board, the external control circuit board being provided with a first chip, and the external control circuit board electrically communicating with the original control circuit board; and an inner container and an internal control circuit board, the internal control circuit board being installed on the inner container, the internal control circuit board being provided with a second chip, and the internal control circuit board being provided with internal contacts;

wherein after the inner container is placed in the cartridge shell, the external control circuit board electrically communicates with the internal contacts, and the first chip or the second chip stores actual ink volume data of the inner container and an adopted program; and wherein the external control circuit board and the internal control circuit board are connected through a conductive piece.

10. The inner container type ink cartridge according to claim 9, wherein the cartridge shell is provided with a communication hole, so that external contacts, corresponding to the internal contacts, on the external control circuit board penetrate through the communication hole and extend into the shell slot, and after the inner container is placed in the shell slot, the external contacts in the shell slot communicate with the internal contacts.

11. The inner container type ink cartridge according to claim 9, wherein two circuit connection ports are arranged on the conductive piece, and the two circuit connection ports of the conductive piece are respectively connected with the external contacts of the external control circuit board and the internal contacts of the internal control circuit board.

12. The inner container type ink cartridge according to claim 9, wherein an opening of the cartridge shell is provided with a connection slot, so that the external control circuit board is clamped on the connection slot, some external contacts communicate with the original control circuit board, and remaining external contacts are located in the shell slot; in this way, after the inner container is placed in the shell slot, the internal contacts communicate with the external contacts located in the shell slot.

13. The inner container type ink cartridge according to claim 9, wherein some external contacts on the external control circuit board are connected with the contacts on the original control circuit board, the external control circuit board is bent into the shell slot along the mouth of the shell slot, and remaining external contacts are located in the shell slot, so that when the inner container is installed in the shell slot, the external contacts in the shell slot communicate with the internal contacts.

* * * * *